US005474172A

United States Patent [19]

Zavatone et al.

[11] Patent Number: 5,474,172

[45] Date of Patent: Dec. 12, 1995

[54] PAPERBOARD BOTTLE CARRIER WITH HANDLE

[75] Inventors: James F. Zavatone, Dover, Mass.; Robert L. Gordon, Monroe; Linda A. Bernstein, Campbell Hall, both of N.Y.

[73] Assignee: International Paper, Purchase, N.Y.

[21] Appl. No.: 284,863

[22] Filed: Aug. 2, 1994

[51] Int. Cl.[6] ..... B65D 75/00

[52] U.S. Cl. ..... 206/158; 206/147; 206/148; 206/161

[58] Field of Search ..... 206/141, 147, 206/148, 151, 153, 158, 199, 427, 161

[56] References Cited

U.S. PATENT DOCUMENTS

| | | | |
|---|---|---|---|
| 2,397,716 | 4/1946 | Wendler | 206/148 |
| 2,783,690 | 3/1957 | Crary . | |
| 2,989,177 | 6/1961 | Swick . | |
| 3,206,104 | 9/1965 | Cohen . | |
| 3,209,982 | 10/1965 | Laster . | |
| 3,315,876 | 4/1967 | Vander Jagt . | |
| 3,711,143 | 1/1973 | Smed | 206/158 |
| 3,801,012 | 4/1974 | Thelen . | |
| 4,498,620 | 2/1985 | Dickert . | |
| 4,583,681 | 4/1986 | Neese . | |
| 4,905,888 | 3/1990 | Suoss . | |
| 5,188,225 | 2/1993 | Jorba | 206/158 |
| 5,323,895 | 6/1994 | Sutherland et al. | 206/147 |
| 5,415,278 | 5/1995 | Sutherland | 206/148 |

*Primary Examiner*—David T. Fidei
*Attorney, Agent, or Firm*—Michael J. Doyle

[57] ABSTRACT

A bottle carrier is formed of two superposed panels of paperboard having a plurality of bottle neck receiving openings and a handle sandwiched between the panels. Each opening has a plurality of radially extending fingers whose ends engage beneath a portion of an abutment associated with each bottle neck. Each finger is bent upwardly at about 45 degrees after insertion of a bottle into a respective opening. Each finger is provided with a microcut line on its upper surface, each microcut line extending about 10–50% through the paperboard. Such microcut lines facilitate removal of the bottles from the carrier by permitting easier rupture. The handle has a manually accessible flexible strip at the upper surface of the uppermost panel or section, one end of the strip being folded prior to use.

7 Claims, 2 Drawing Sheets

FIG. 1
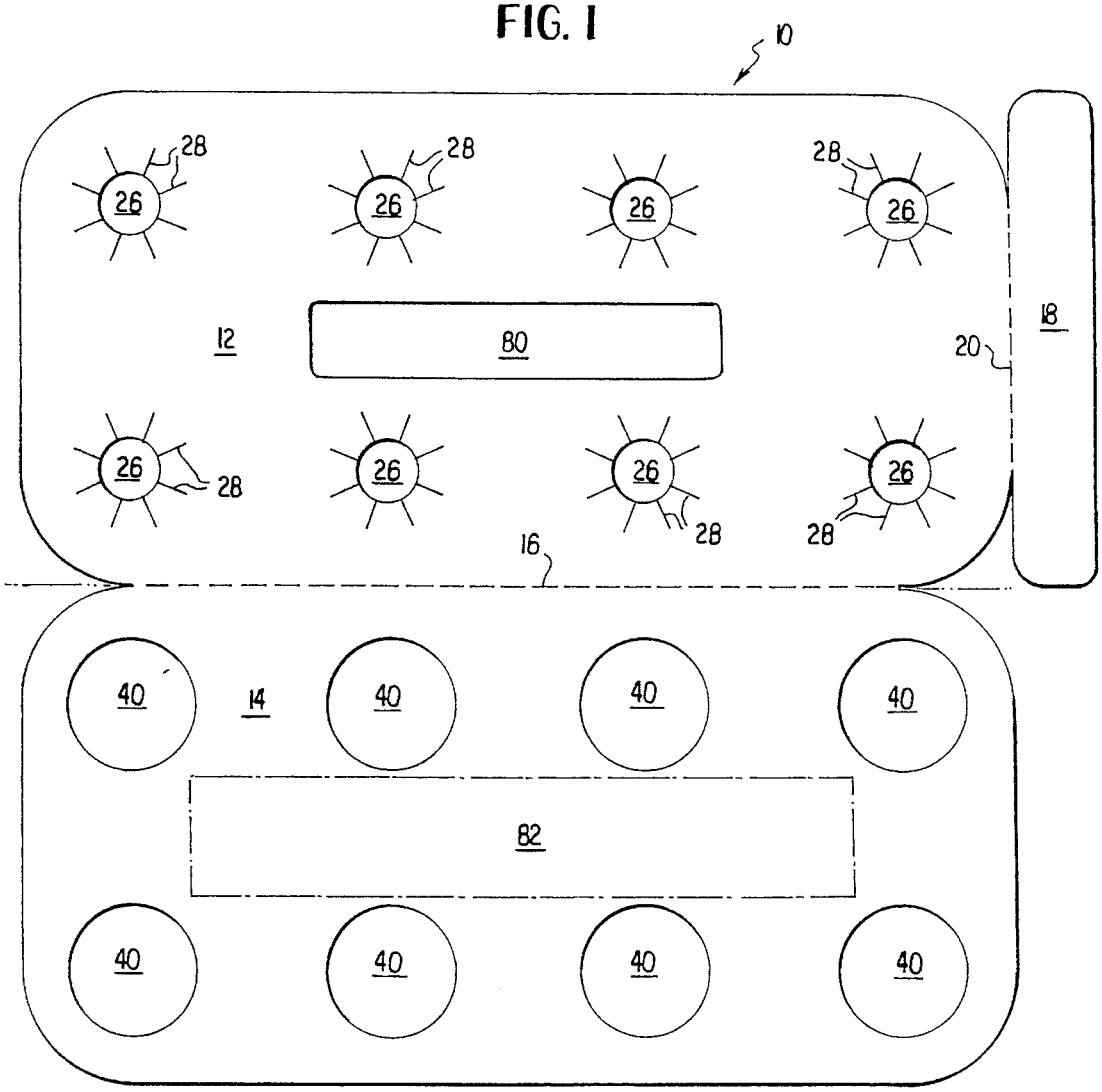
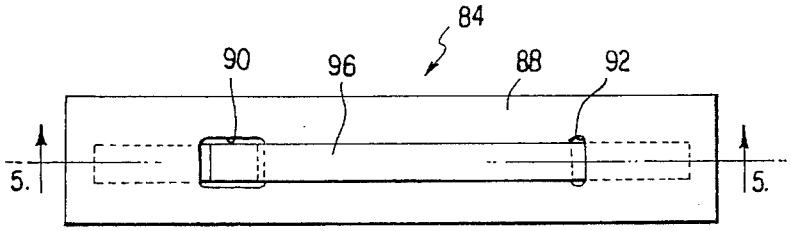
FIG. 2

FIG. 3
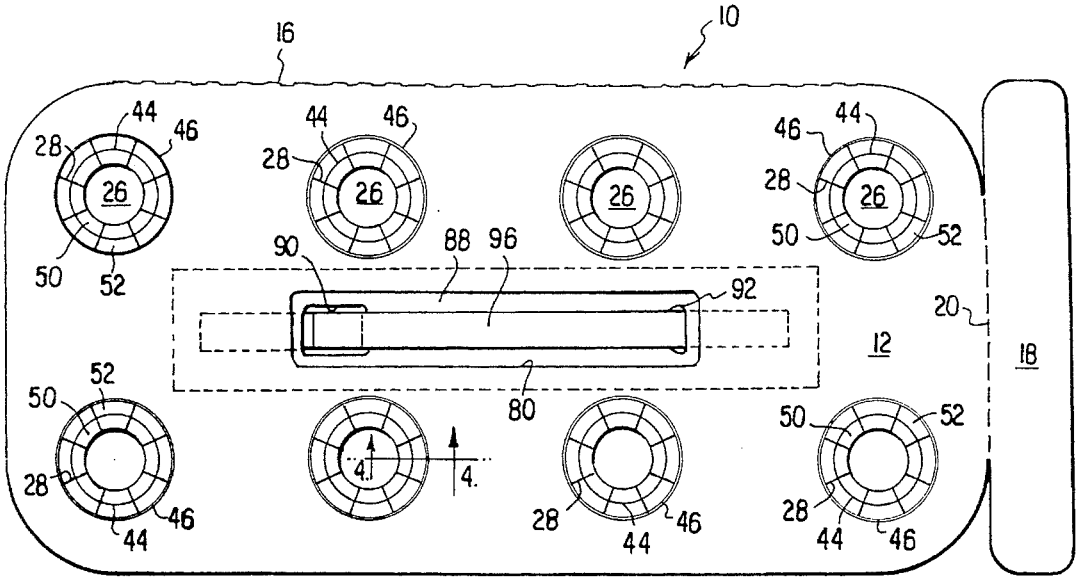
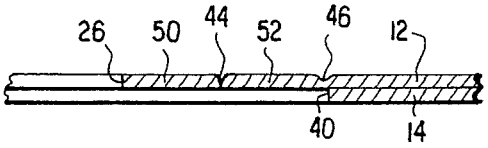
FIG. 4
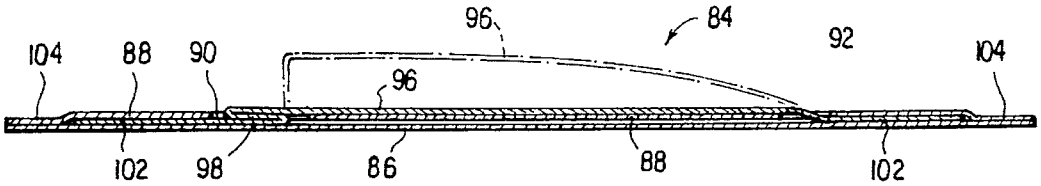
FIG. 5

PAPERBOARD BOTTLE CARRIER WITH HANDLE

BACKGROUND OF THE INVENTION

This invention relates to bottle carriers of the type fashioned from one or more planar sheets of paperboard, the carrier having a plurality of openings for receiving respective bottles. Each bottle receiving opening has a plurality of radially outwardly extending fingers defined by cuts through the paperboard. In general, such carriers have been used largely for cans. Examples of constructions of this general type are shown in U.S. Pat. Nos. 3,834,750 issued to Gauntlett, 3,156,358 issued to Randrup, and 5,125,506 issued to Galbierz et al.

While planar bottle carriers have been relatively successful for carrying cans, such as soft drink cans or the like, they have not been widely accepted for carrying plastic bottles. Generally, an annular flange often on the neck of such bottles or the screw caps on the bottles are so much larger in diameter than the diameter of the openings in the planar carrier that it is often difficult to remove a bottle from its respective opening.

SUMMARY OF THE INVENTION

As described in copending U.S. patent application entitled Paperboard Bottle Carrier by Linda A. Bernstein, filed Jun. 30, 1994 and incorporated by reference, known sheet or planar bottle carriers, fashioned as for example from paperboard and having a plurality of radially extending fingers at respective bottle openings, are provided with an annular microcut (microcut line) extending either completely or partially around the opening and spaced radially outwardly therefrom. The microcut lines extend approximately 10 to 50% through the thickness of the paperboard, and extend from the top surface towards the bottom surface of the paperboard and not in the opposite direction. Each microcut is thus on that surface of the bottle carrier nearest the top of the bottle associated with that particular opening. According to the practice of this invention, a bottle carrier of the type described in the above noted Bernstein application is improved by the addition of a strap carrying handle.

BRIEF DESCRIPTION OF THE DRAWINGS

FIG. 1 is a plan view of a unitary blank of paperboard or other flexible, foldable, and resilient sheet material from which the bottle carrier of this invention is fashioned.

FIG. 2 is a plan view of a strap handle.

FIG. 3 shows the blank of FIG. 1 after it has been provided with the handle of FIG. 2 and folded about a central fold line, with FIG. 3 showing the top of the bottle carrier.

FIG. 4 is a view taken along section 4—4 of FIG. 3.

FIG. 5 is a view taken along section 5—5 of FIG. 2.

DETAILED DESCRIPTION OF THE INVENTION

Referring now to FIG. 1 of the drawings, a unitary blank 10 is fashioned of paperboard or other stiff, foldable and resilient sheet material, typically such as 57# Kraft/57# Kraft paperboard, and typically of a caliper 0.030 to 0.032 inches. Blank 10 is generally rectangular and has an upper section 12, a lower section 14, both generally rectangular, and a fold line 16 separating and partially defining these two sections. Upper section 12 at one end is provided with an optional integral extension 18 foldably secured thereto by fold line 20, to function to carry advertising or other printed indicia. Upper section 12 is provided with a plurality of circular openings 26 and a rectangular handle receiving opening 80, with a plurality of radial cut lines 28 associated with each opening 26 extending completely through the paperboard. Radial cut lines 28 are sometimes termed starbursts. Lower section 14 is provided with a plurality of bottle receiving openings 40, typically circular, and are homologously or congruently located with respect to openings 26. The area enclosed by dashed lines 82 is adapted to receive a handle base, shortly to be described.

FIG. 2 shows a handle 84, also shown at FIG. 5. Handle 84 is of paperboard laminar construction and includes an upper layer 88 having longitudinally spaced openings 90 and 92, an intermediate flexible strap or strip 96, and a bottom layer 86. The longitudinal ends of handle 84 are sealed together as by adhesive at regions 104 and sandwich ends 102 of strip 96. A fold 98 in the form of a flattened Z is located at the region of larger opening 90. Bottom or base layer 86 of handle 84 is adhered to region 82 of panel 14 so that flexible strip 96 faces the reader at FIG. 1. Handle 84 is available from Wilton Packaging Products of Palatine, Ill. and is of plastic/paper laminates and apart from its use in the bottle carrier forms no part of this invention.

Referring now to FIG. 3, sections 12 and 14 of the blank of FIG. 1 have been folded about fold line 16 and glued together. Openings 26 in upper section 12 and openings 40 in lower section 14 are homologous, so that upon folding and glueing the two sections together, respective openings 26 and 40 are pairwise aligned. The top surface of upper section 12 (facing the reader at FIG. 3) differs from the bottom surface of upper section 12, the latter facing the reader at FIG. 1, in the addition, in the top surface of section 12, of circular microcut lines 44 surrounding and located radially outwardly of each opening 26. Microcut lines 44 extend from the top or upper surface of section 12 down towards its bottom or opposite surface, as is shown in FIG. 4. For each opening 26, a corresponding microcut line 44 intersects radially extending cuts 28. The radially outermost portions of radial cuts 28 terminate at a circular and annularly continuous indentation 46. Indentation 46 is optional and forms no part of this invention and may be omitted. The intersection of each microcut line 44 with respective radially extending cuts 28 defines a plurality of radially innermost sections 50 and radially outermost sections 52, for each opening 26. The arrangement is such that a plurality of radially extending fingers are formed, with each finger defined by sections 50, 52. Microcut line 44 substantially transversely intersects each finger 50, 52 approximately midway along its radial length. As disclosed in the noted copending Bernstein application microcut lines 44 need not be annularly continuous across the full width of the fingers, nor need they be arcuate.

Flexible strip 96 faces the reader at FIG. 3, with opening 90 receiving it. As indicated by the dashed lines in FIG. 3 most of handle 84 is sandwiched by panels 12 and 14 except for flexible strip 96.

The carrier is loaded with bottles as described in the noted copending Bernstein patent application, with fingers 50, 52 tilting upwardly at about 45 degrees and is carried by the ultimate consumer by strip 96. The carrying configuration of the handle is shown in dashed lines at FIG. 5, the strip having been extended by pulling it upwardly and unfolding Z fold 98 to permit the fingers to engage beneath the strip.

The presence of the Z fold permits the carriers to be stacked before bottle loading while providing sufficient length of strip 96 for consumer carrying after bottle loading.

While the upper section 12 and lower section 14 are shown as integral, being joined at fold line 16, it is seen that they may be made separate and aligned into edge registry and then glued together to similarly sandwich handle 84.

Geometrical terms of orientation, such as upper, lower ,and the like are used to facilitate the description and are not intended as limiting.

We claim:

1. A bottle carrier formed from a folded unitary paperboard blank and a paperboard handle, said blank being generally rectangular and having a fold line dividing said blank into upper and lower generally rectangular sections, said upper section having a plurality of bottle neck receiving openings, said bottom section having a like number of openings and being homologously arranged so that upon folding said blank about said fold line and overlapping said upper and lower sections said upper and said lower section openings are pairwise aligned, said upper section openings each having a plurality of cut lines extending through said paperboard and extending radially outwardly from each said upper section opening to thereby define a plurality of radially extending fingers for each said opening, a microcut line substantially transversely intersecting each of said radially extending fingers, each said microcut line extending from said top surface of said upper section towards said bottom surface of said upper section, said upper section having an elongated opening substantially centrally thereof, a handle having a portion sandwiched between said upper and lower sections, said handle having a flexible strip, said flexible strip located within said substantially central opening in said upper section so as to be accessible from said upper section.

2. The carrier of claim 1 wherein said microcut lines extend about 10 to 50% through said upper section.

3. The carrier of claim 1 wherein one end of said handle flexible strip is folded to a flattened configuration.

4. The carrier of claim 3 wherein said microcut lines extend about 10 to 50% through said upper section.

5. A bottle carrier formed from upper and lower generally rectangular paperboard sections, said upper section having a plurality of bottle neck receiving openings, said bottom section having a like number of openings and being homologously arranged so that upon registering said upper and lower sections said openings are pairwise aligned, said upper section openings each having a plurality of cut lines extending through said paperboard and extending radially outwardly from each said upper section opening to thereby define a plurality of radially extending fingers for each said opening, a microcut line substantially transversely intersecting each of said radially extending fingers, each said microcut line extending from said top surface of said upper section towards said bottom surface of said upper section, said upper section having and elongated opening substantially centrally thereof, a handle having a portion sandwiched between said upper and lower sections, said handle having a flexible strip, said flexible strip located within said substantially central opening in said upper section so as to be accessible from said upper section.

6. The carrier of blank of claim 5 wherein said microcut lines extend about 10 to 50% through said upper section.

7. The carrier of claim 5 wherein one end of said flexible strip is folded to a flattened configuration.

* * * * *